US005261509A

United States Patent [19]

Cattini

[11] Patent Number: 5,261,509

[45] Date of Patent: Nov. 16, 1993

[54] BRAKE BLOCK FOR THE BOLT CARRIER SHAFT IN AUTOMATIC FABRIC SPREADERS

[75] Inventor: Flavio Cattini, Bergamo, Italy

[73] Assignee: FK Arna S.r.l., Bergamo, Italy

[21] Appl. No.: 816,953

[22] Filed: Jan. 3, 1992

[30] Foreign Application Priority Data

Apr. 3, 1991 [IT] Italy ..... BS/91/A/000036

[51] Int. Cl.[5] ..... B65H 59/10

[52] U.S. Cl. ..... 188/67; 188/220.6; 74/107

[58] Field of Search ..... 188/43, 67, 71.7, 72.1, 188/72.3, 72.7, 72.9, 24.19, 196 M, 219.1, 219.6, 220.1, 220.6; 74/107, 156; 192/70.25, 111 R, 111 B, 111 T

[56] References Cited

U.S. PATENT DOCUMENTS 557,699 4/1896 Pirch ..... 188/220.6
3,184,003 5/1965 Kershner ..... 188/73
3,228,493 1/1966 Kershner ..... 74/107
3,456,895 7/1969 Scordato ..... 242/75.46
3,817,111 6/1974 Allen ..... 188/67 X

FOREIGN PATENT DOCUMENTS 520318 3/1931 Fed. Rep. of Germany ..... 188/43
949915 2/1964 United Kingdom .

*Primary Examiner*—Robert J. Oberleitner
*Assistant Examiner*—Lee W. Young
*Attorney, Agent, or Firm*—McGlew and Tuttle

[57] ABSTRACT

The invention relates to a brake block especially for the roll carrier shaft in fabric tenters which has: two opposite braking blocks (13, 14) carried by two shoes (15, 16) which are pivoted on a support (18) and movable in a scissor action; control members (23, 24) which are inserted between the tails of said shoes for their movement in scissor action and the closing/opening of the blocks on the shaft to be braked; and an actuator (12) for the movement of said control members.

5 Claims, 1 Drawing Sheet

BRAKE BLOCK FOR THE BOLT CARRIER SHAFT IN AUTOMATIC FABRIC SPREADERSFIELD OF THE INVENTION

The present invention relates to brakes especially for the bolt carrier shaft in automatic fabric spreaders.

BACKGROUND OF THE INVENTION

Brake blocks can be coordinated to the shaft which carries the bolt of fabric in equipment for the spreading of the fabric. The brake blocks are usually stressed by springs and with a mechanical control which, however, does not allow for a variable and adjustable braking action as experts well know.

SUMMARY AND OBJECT OF THE INVENTION

The present invention aims to solve the braking problem of the bolt carrier shaft in fabric spreaders through a brake block which does not have a mechanical, but pneumatic or electromagnetic control and with a possibility of adjusting the brake force.

Another object of the invention is to supply a brake whose blocks have pivoted scissor shoes and in which a block is in an adjustable position on the relative shoe and therefore relative to the opposite block.

BRIEF DESCRIPTION OF THE DRAWINGS

The brake block here proposed will be described in further detail with reference being made to the attached drawings in which.

DETAILED DESCRIPTION OF THE PREFERRED EMBODIMENT

Figure 2:
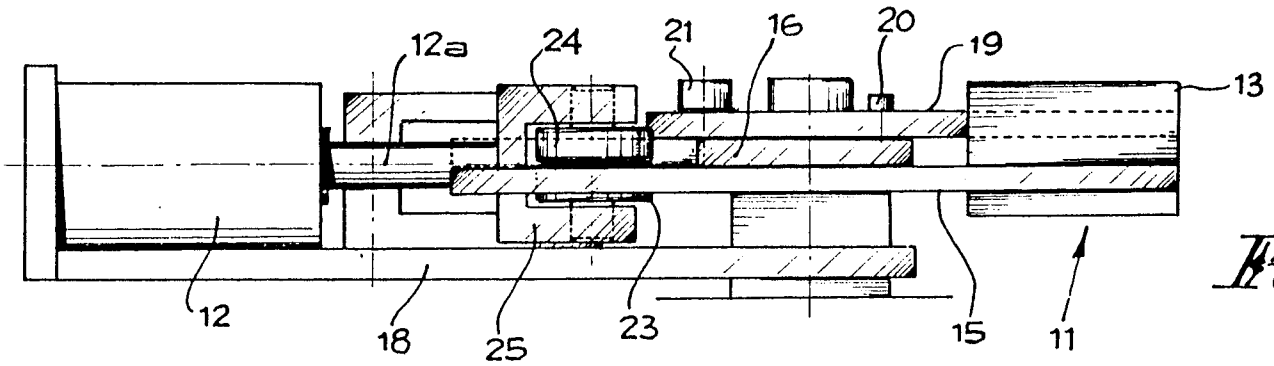
FIG. 2 is a side elevation of the brake in FIG. 1.

The brake (11) in accordance with the invention is controlled by a pneumatic cylinder (12) and has a shaft (10) to be braked, the shaft carrying a bolt of fabric for spreading. The brake (11) has two opposite blocks (13, 14) carried by two respective shoes (15, 16) which are pivoted in a scissor type action between each other through a pin (17) fixed onto a support (18) onto which a pneumatic cylinder (12) is also secured.

Figure 1:
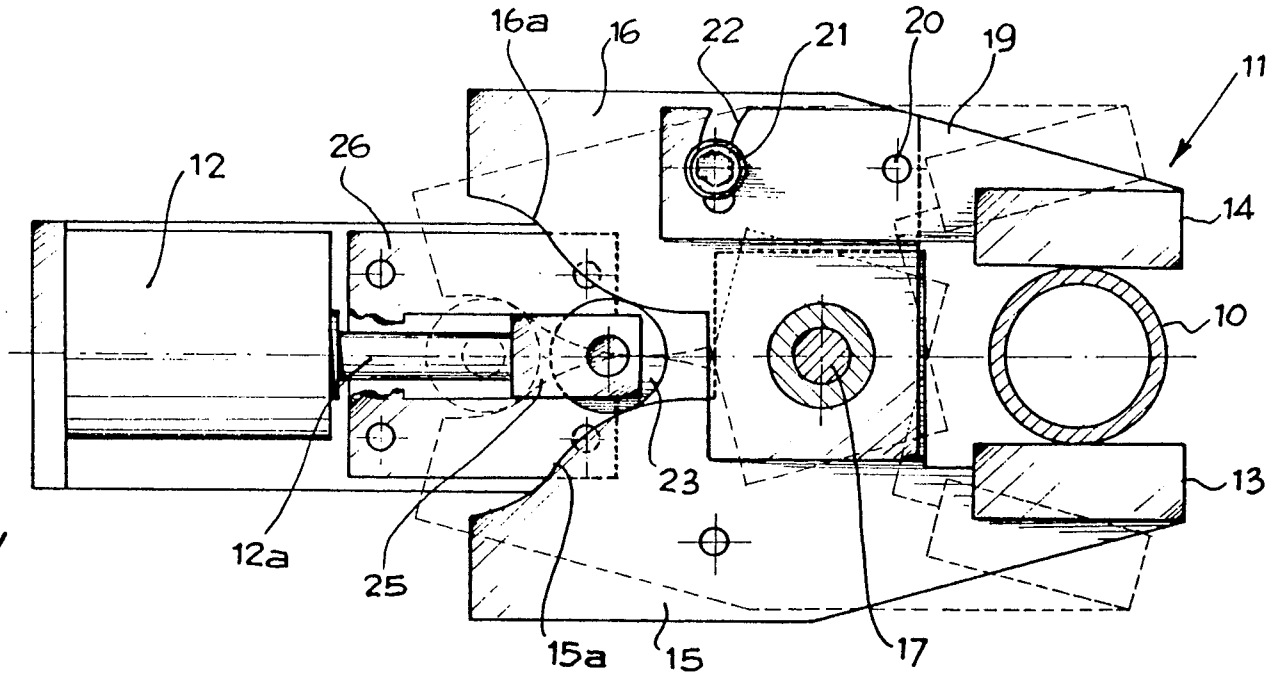
FIG. 1 is a schematic drawing of the brake with its actuator in association with a shaft to be braked.

A block (13) is fixed directly onto the end of a shoe (15) whilst the other block (14) is applied to the respective shoe (16) through an adjusting element (19). So, the block (14) is fixed to the adjusting element (19) which is also fixed to the shoe (16) through a screw pin (20) and also through a blocking screw (21) which passes in an arched slit (22) formed in the same element (FIG. 1). It is thus possible to move the adjusting element (19) so as to vary the position of the block (14) in relation to the other block (13), therefore to the shaft (10), by unloosening the blocking screw (21). The screw (21) is then tightened so as to stabilize the new position of the blocks.

The shoes (15, 16) which are on the opposite sides of the blocks in respect to the pin (17) have relative cam-shaped facing sides (15*a*, 16*a*) with such a slide so as to allow for the scissor type movements of the shoes for the closing and opening of the blocks on the shaft to be braked when control members are inserted between the tails of the shoes.

The control members are advantageously made from two rollers (23, 24), one of which rests against the cam-shaped side (15*a*) of the shoe (15) and the other against the cam-shaped side (16*a*) of the other shoe (16). Said rollers (23, 24) are assembled on a fork (25) which is fixed and movable with the stem (12*a*) of the pneumatic cylinder (12) and which is operated between driving elements (26) which prevent any possibility of rotation and of wobbling of the fork itself.

When the cylinder (12) keeps the rollers (23, 24) back, the block (13, 14) remain open without interfering with the shaft (10). In order to brake, the cylinder (12) moves the rollers (23, 24) forward which work on the cam-shaped sides (15*a*, 16*a*) of the shoes (15, 16) and move these in a scissor action so as to tighten the braking blocks on the shaft to be braked.

Changes can however be made to the above described brake but still remain in accordance with the invention. Finally, an electromagnetic device can be used as a control member in the place of the pneumatic cylinder with the same results.

I claim:

1. A brake block for a bolt carrier shaft of an automatic fabric spreader, comprising:

a first braking block;

a second braking block;

a first shoe;

a second shoe, said first shoe and said second shoe being connected to a support by a pivot for pivotal movement about said pivot, said first braking block being fixed to an end of said first shoe and said second braking block being fixed to an adjusting element, said adjusting element being positionable and moveable on said second shoe for adjusting a position of said second braking block in relation to said first braking block, said adjusting element including an arched slit;

pivot means connecting said adjusting element and said second shoe for pivotal movement between said adjusting element and said second shoe;

fixing means for fixing a relative position between said adjusting element and said second shoe;

control members inserted between a tail end surface of each of said first shoe and said second shoe for movement of said first and second shoe about said pivot for a closing and opening of said first block in said second block on the shaft to be braked;

and an actuator connected to said control members for moving said control members.

2. A brake block for a bolt carrier shaft of an automatic fabric spreader, comprising:

a first braking block;

a second braking block;

a first shoe;

a second shoe, said first shoe and said second shoe being connected to a support by a pivot for pivotal movement about said pivot, said first braking block being fixed to an end of said first shoe and said second braking block being fixed to an adjusting element, said adjusting element being positionable and moveable on said second shoe for adjusting a position of said second braking block in relation to said first braking block, said adjusting element including an arched slit;

a blocking screw pivotally connecting said adjusting element and said second shoe, a screw pin passing through said arched slit and engaging said second shoe for fixing said adjusting element relative to said second shoe;

control members inserted between a tail end surface of each of said first shoe and said second shoe for movement of said first and second shoe about said pivot for a closing and opening of said first block in said second block on the shaft to be braked;

and an actuator connected to said control members for moving said control members.

3. A brake block according to claim 2 wherein said tail ends of said first shoe and said second shoe define cams, said control members including rollers resting against corresponding said cams.

4. A brake block according to claim 3, wherein said rollers are positioned on fork member between driving guide elements, said fork member being connected to said actuator, said actuator being formed as one of a pneumatic cylinder.

5. A brake block according to claim 3, wherein said rollers are positioned on fork member between driving guide elements, said fork member being connected to said actuator, said actuator being formed as one of a pneumatic cylinder and an electro magnetic device.

* * * * *